US006254109B1

(12) United States Patent
Horton

(10) Patent No.: US 6,254,109 B1
(45) Date of Patent: Jul. 3, 2001

(54) ANTI-LOCK BRAKING SYSTEM FOR ROLLERBLADES

(76) Inventor: Azor Horton, 23766 Crisler, Taylor, MI (US) 48180

( * ) Notice: Subject to any disclaimer, the term of this patent is extended or adjusted under 35 U.S.C. 154(b) by 0 days.

(21) Appl. No.: 09/531,553

(22) Filed: Mar. 20, 2000

(51) Int. Cl.[7] ..... A63C 17/14

(52) U.S. Cl. ..... 280/11.214; 280/11.215; 280/11.211

(58) Field of Search ..... 280/11.214, 11.204, 280/11.205, 11.211, 11.215; 188/24.21

(56) References Cited

U.S. PATENT DOCUMENTS

| | | | | |
|---|---|---|---|---|
| 5,088,748 | | 2/1992 | Koselka et al. . | |
| 5,171,032 | | 12/1992 | Dettmer . | |
| 5,280,930 | | 1/1994 | Smathers et al. . | |
| 5,388,844 | | 2/1995 | Pellegrini et al. . | |
| 5,411,276 | | 5/1995 | Moldenhauer . | |
| 5,415,419 | * | 5/1995 | Bourque | 280/11.214 |
| 5,462,296 | | 10/1995 | Pozzobon . | |
| 5,464,235 | | 11/1995 | Goldman et al. . | |
| 5,468,004 | | 11/1995 | Olson et al. . | |
| 5,752,707 | | 5/1998 | Cottle et al. . | |
| 5,758,885 | | 6/1998 | Lowe . | |
| 5,769,433 | * | 6/1998 | Zorzi et al. | 280/11.214 |
| 5,836,590 | * | 11/1998 | Mitchell et al. | 280/11.214 |
| 5,911,423 | * | 6/1999 | Pellegrini, Jr. et al. | 280/11.214 |
| 5,997,014 | * | 12/1999 | Ellis et al. . | |
| 5,997,015 | * | 12/1999 | Bellehumeur | 280/11.215 |
| 6,010,136 | * | 1/2000 | Hoskin | 280/11.214 |
| 6,039,330 | * | 3/2000 | Hoskin | 280/11.215 |

* cited by examiner

*Primary Examiner*—Brian L. Johnson
*Assistant Examiner*—Elaine Gort
(74) *Attorney, Agent, or Firm*—Richard C. Litman

(57) ABSTRACT

An anti-lock braking system for in-line skates comprises a brake shoe adjacent each wheel of the skates. A skate boot has an articulated cuff for initiating braking action when the cuff is pivoted in a backward or forward direction as selected. Pivoting the cuff functions to move the brake shoes into braking contact with the wheels. Springs are connected to the brake shoes via a cable system to bias the brake shoes out of contact with the wheels and thus to prevent brake lock-up.

15 Claims, 6 Drawing Sheets

ANTI-LOCK BRAKING SYSTEM FOR ROLLERBLADES

BACKGROUND OF THE INVENTION

1. Field of the Invention

The present invention generally relates to braking systems. More specifically, the present invention is drawn to an anti-lock braking system for in-line skates.

2. Description of the Related Art

In-line skating has become a major recreational activity in recent years. The inherent design of in-line skates and the utilization of modern materials allows a skater to attain much faster speeds than was possible with the vintage four-wheeled roller skate. Unfortunately, increased speed has resulted in a greater number of accidents and more severe injuries.

A major problem for in-line skaters has been that of controlled braking. Most prior art systems are designed to apply braking action to only one wheel of an in-line skate. Such one-wheel application tends to produce a fair amount of skidding and thus decrease directional control. Examples of one-wheel braking systems are disclosed in U.S. Pat. No. 5,388,844 (Pellegrini, Jr. et al.), U.S. Pat. No. 5,462,296 (Pozzobon), U.S. Pat. No. 5,468,004 (Olson et al.) and U.S. Pat. No. 5,752,707 (Cottle et al.).

Other in-line braking systems require that the skater manipulate hand-held levers. Besides affecting balance, the requirement that the levers are constantly held causes the skater to lose the freedom that has helped to make the activity so popular. Examples of the above type systems are shown in U.S. Pat. No. 5,171,032 (Dettmer), U.S. Pat. No. 5,280,930 (Smathers et al.), U.S. Pat. No. 5,411,276 (Moldenhauer) and U.S. Pat. No. 5,464,235 (Goldman et al.).

U.S. Pat. No. 5,088,748 (Koselka et al.) discloses an anti-lock braking system for in-line skates. It is noted however, that positive braking force is not applied to all the wheels of the skate.

U.S. Pat. No. 5,758,885 (Lowe) shows a system wherein braking is applied to all wheels of a single skate. The instant patent does not contemplate the type of brakes which can be utilized on both skates.

None of the above inventions and patents, taken either singularly or in combination, is seen to disclose an anti-lock braking system for in-line skates that applies braking force to all the wheels of the skates as will subsequently be described and claimed in the instant invention.

SUMMARY OF THE INVENTION

The present invention comprises an anti-lock brake system for in-line skates which employs a brake shoe adjacent each wheel of the skate. Springs, common to all the shoes, bias each shoe to a position out of contact with its respective wheel. Tension is applied to a cable to cause each shoe to contact its respective wheel when braking is desired. The cable has both of its ends attached to the springs. The cable is threaded through each brake shoe and extends around a specially designed wish bone device located on a rear surface of the skater's boot. A tension applying structure also located on the rear surface of the boot, above the wish bone device, functions to provide tension to the cable when braking is desired. The system is designed such that tension is applied to the cable when the skater causes the cuff of the boot to pivot in a backward direction. Alternatively the cable may be threaded so that a forward pivoting of the cuff will initiate braking. Since the springs are constantly biasing the brake shoes away from the wheels, brake lockup and attendant skidding cannot occur. Thus, controlled braking may be accomplished.

Accordingly, it is a principal object of the invention to provide a safe braking system for in-line skates.

It is another object of the invention to provide a braking system for in-line skates, which system is designed with antilocking features.

It is a further object of the invention to provide a braking system for in-line skates in which braking may be initiated by rotational movement of a portion of the skate boot.

Still another object of the invention is to provide a braking system for in-line skates in which positive braking force is applied all wheels of the skates. to It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
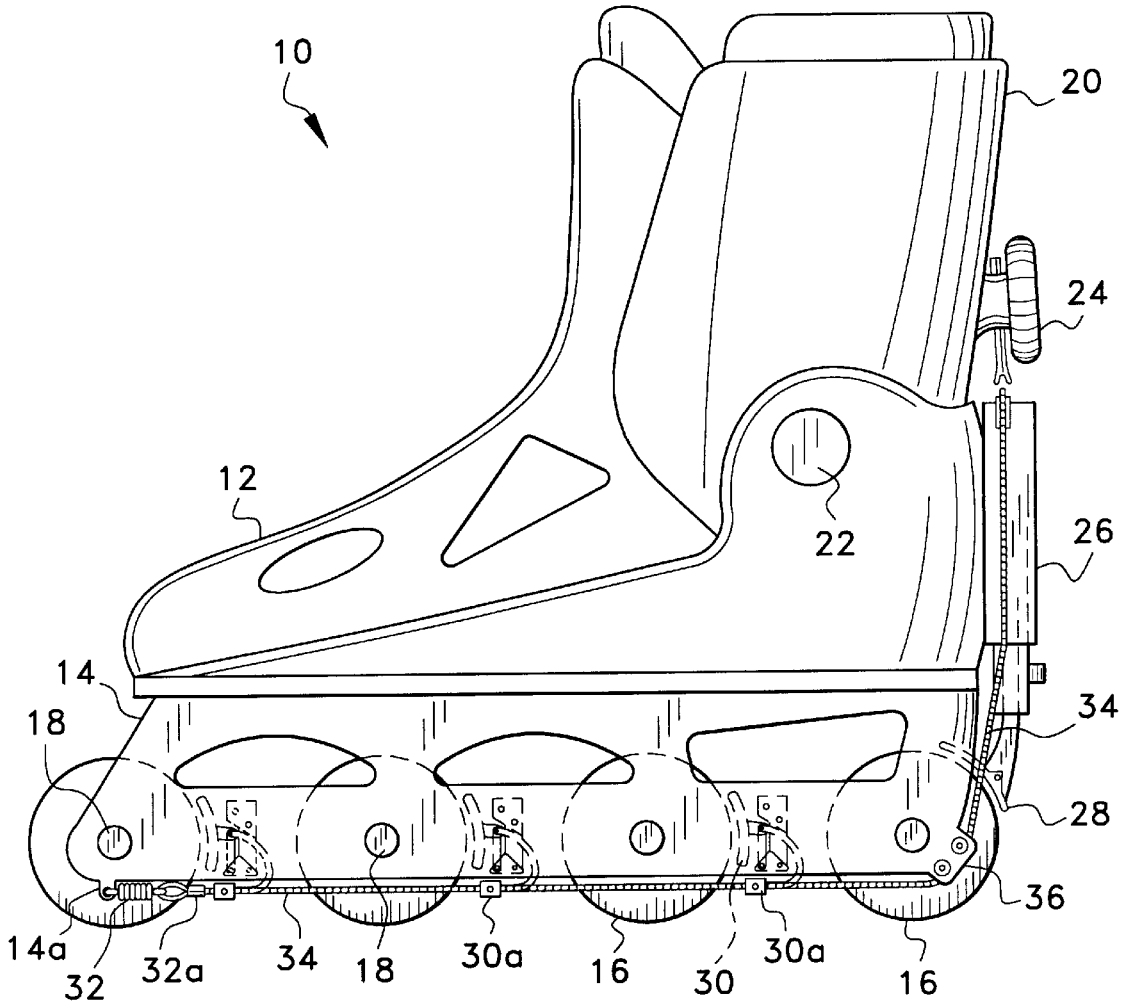
FIG. 1 is an environmental, side view of an anti-lock braking system for in-line skates according to the present invention.

Attention is directed to FIG. 1 which illustrates an in-line skate generally at 10. Skate 10 includes boot 12 mounted to a frame 14. A plurality of wheels 16 are mounted to the frame for rotation on axles 18. A cuff 20 is articulated to boot 12 at attachment point 22. Plural conventional fasteners (not shown) may be provided to secure the boot and cuff to the skater's foot and lower leg. A brake line adjuster assembly 24 is mounted on a rear outer surface of cuff 20. Mounted on boot 12 directly below adjuster assembly 24 is wish bone assembly 26. More detailed descriptions of adjuster assembly 24 and wish bone assembly 26 will be given below.

Figure 2:
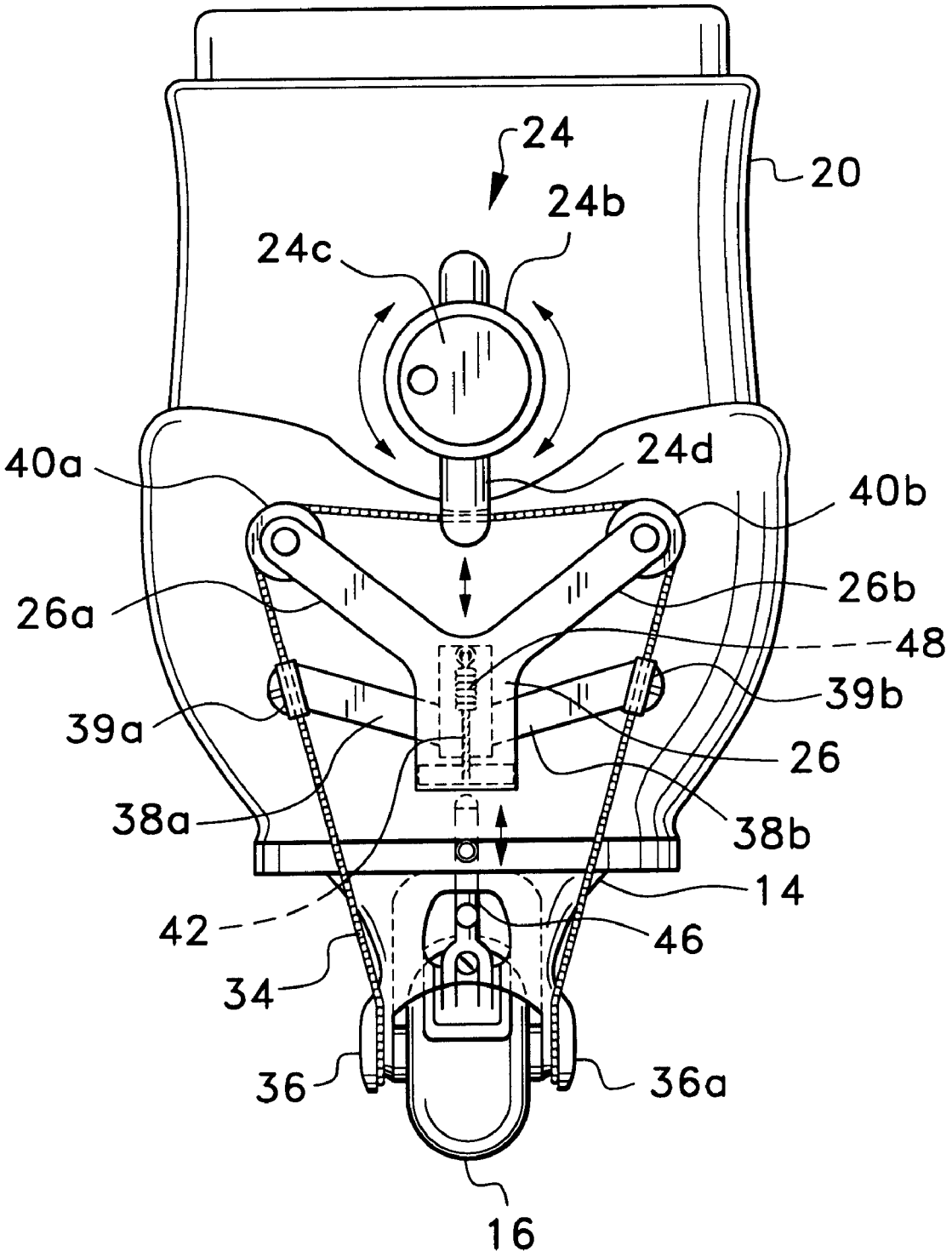
FIG. 2 is a rear view of an anti-lock braking system for inline skates according to the present invention.

Brake shoe 28 is positioned adjacent the rearmost of wheels 16 and functions to contact the rearmost wheel when braking is initiated by the skater. In similar fashion, identically designed brake shoes 30 function to contact a respective adjacent wheel 16 upon brake initiation. A spring 32 is secured at one end to a front portion of frame 14 adjacent the outer side of the forward-most wheel. Spring hitch loop 14*a* is provided to secure the spring to the frame. A second end of spring 32 is affixed by a metal clad 32*a* to one end of a cable 34. Identical spring/loop/cable structure (not shown) is disposed on the inner side of the forward-most wheel. Cable 34 extends from spring 32 through channels 30*a* of brake shoes 30. Cable 34 is locked in each channel 30*a* by means of a set screw. Cable 34 extends from the rearmost channel 30*a* through roller structure 36. Roller structure 36 is secured to the outer rear end of frame 14. As best seen in FIG. 2, an identical roller structure 36*a* is secured to the inner rear end of frame 14.

Attention continues to be directed to FIG. 2 which shows cable 34 extending from roller structure 36 through channel 39*a*. Channel 39*a* is fixed to one end of arm 38*a*. A set screw (not shown) secures cable 34 in channel 39*a*. From channel 39*a*, cable 34 is threaded over roller tracks 40*a* and 40*b* which are positioned at the respective ends of arms 26*a* and 26*b* of wish bone assembly 26. The cable then extends through channel 39*b* and onto rollers 36*a*. Channel 39*b* is positioned at the end of arm 38*b*. Set screws (not shown) secure the cable in channels 39*a* and 39*b*. From rollers 36*a* the cable is threaded through the brake shoe channels on the inner side of the frame and connected to the spring on the inner side of the forward-most wheel.

Figure 3:
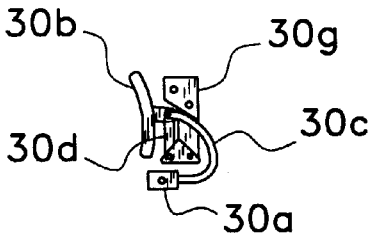
FIG. 3 is a side view of a brake shoe assembly according to the present invention.
Figure 4:
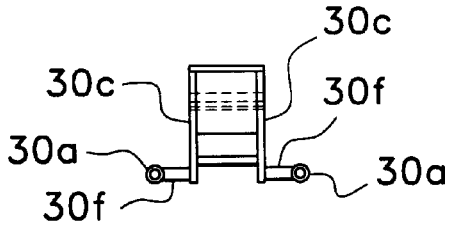
FIG. 4 is a rear view of a brake shoe assembly according to the present invention.
Figure 5:
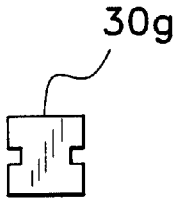
FIG. 5 is a plan view of an element of a brake shoe assembly according to the present invention.

FIGS. 3–5 best show the detailed structure of break shoes. Each shoe 30 is provided with a cupped surface 30*b* designed to contact the wheel surface when brake are applied. Curved radius arms 30*c* have respective ends connected to surface 30*b* via hinged plates 30*d* (only one shown). The other ends of curved arms 30*c* terminate in inner and outer channels 30*a*. Channels 30*a* are connected to curved arms 30*c* by joints 30*f*, which joints allow curved arms 30*c* to swivel relative to channels 30*a*. A series of dowel pins (shown in phantom lines) and a plate 30*g* interconnect the assembly for bracing and movement consistency.

Figure 6:
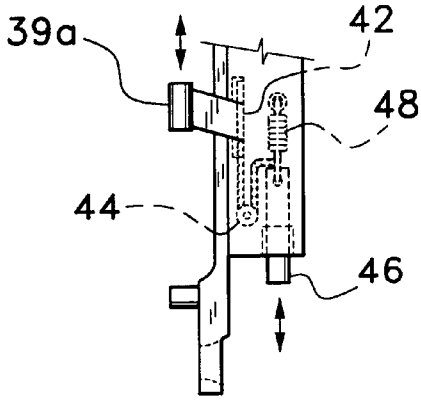
FIG. 6 is a partial sectional view of FIG. 2 according to the present invention.
Figure 7:
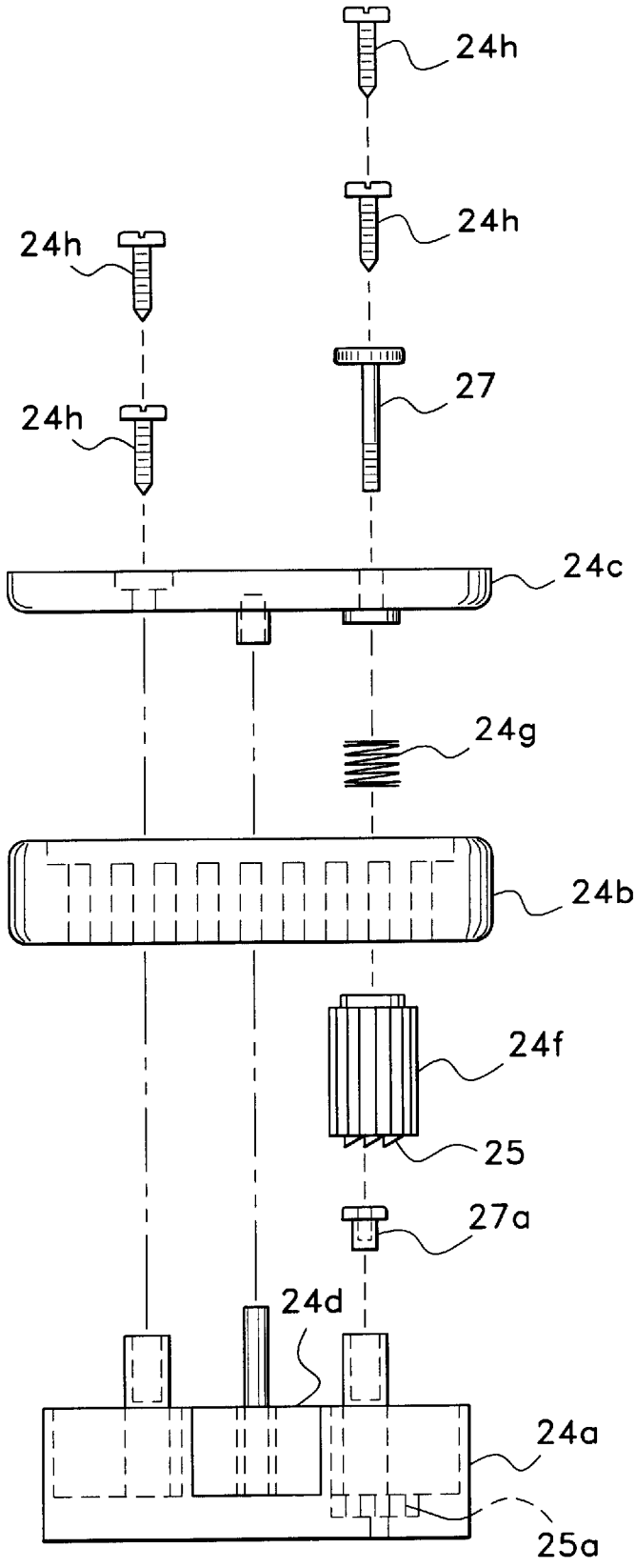
FIG. 7 is an exploded, sectional view of a brake line adjuster according to the present invention.
Figure 8:
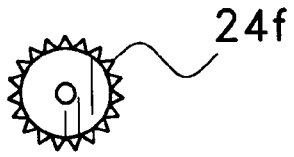
FIG. 8 is a plan view of an element of the brake line adjuster according to the present invention.
Figure 9:
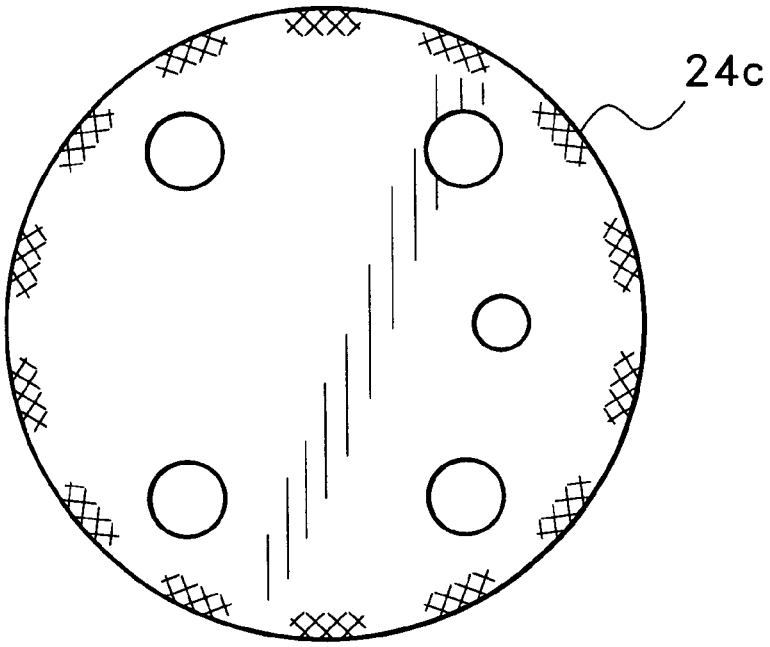
FIG. 9 is a plan view of an element of the brake line adjuster according to the present invention.
Figure 10:
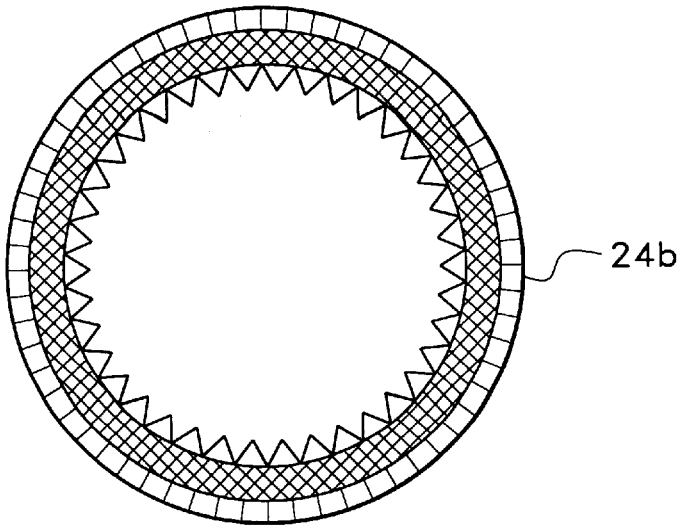
FIG. 10 is a plan view of an element of the brake line adjuster according to the present invention.
Figure 11:
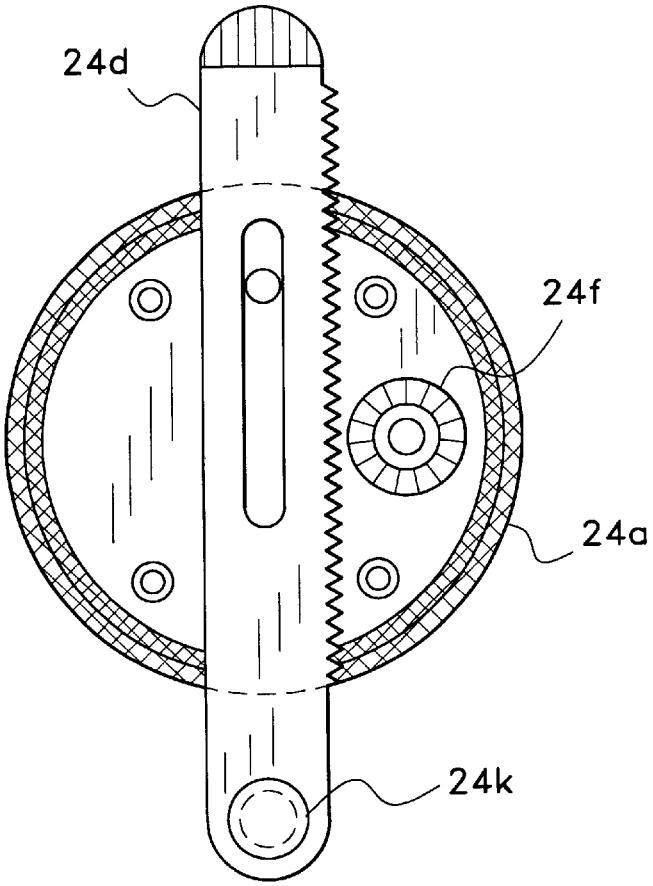
FIG. 11 is a sectional view of the brake line adjuster assembly according to the present invention.

Attention is now directed to FIGS. 2 and 6 for details of wish bone assembly 26. Arms 38*a* and 38*b* are securely connected at their inner ends to one end of a steel cable 42. Cable 42 is looped around a small roller 44 and has a second end connected to an upper end of an adjustable brake rod 46. A coiled spring 48 has a lower end also connected to the upper end of brake rod 46. Coiled spring 48 is secured at its upper end to wish bone 26. Spring 48 biases rod 46 in an upward direction. The lower end of rod 46 terminates in brake shoe 28. Spring 48 biases the rod in an upward direction such that brake shoe 28 is normally out of contact with the rearmost wheel 16. Details of brake line adjuster 24 are shown in FIGS. 7–11. Adjuster 24 comprises bottom portion 24*a*, rotatable hub 24*b*, and cover 24*c*. The outside diameter of hub 24*b* is coated with rubber to enhance gripping and turning. A channel formed in bottom portion 24*a* houses a plastic bar 24*d*. Bar 24*d* (FIG. 11) has gear teeth formed on one side thereof and is fabricated with a central, elongated slot designed to control incremental vertical travel. Gear element 24*f* is disposed to mesh with the teeth of bar 24*d*. Hub 24*b* engages the top of gear element 24*f* such that the gear element will be rotated when the hub is rotated. Gear element 24*f* also has teeth 25 that will mesh with portion 25*a* to lock the gear in a desired position. A knobbed shank 27 is screwed into pilot nut 27*a* such that gear 24*f* will be quickly released when the shank is pulled upwardly. Spring member 24*g* and fasteners 24*h* are utilized to retain the elements firmly in place. At its lower end, bar 24*d* is provided with a spool 24*k* for engagement with cable 34. FIGS. 8–10 respectively illustrate plan views of gear element 24*f*, cover 24*c*, and hub 24*b*. Indicia may be provided on the cover, if desired, for pre-determined tension settings of bar 24*d*. Upon quick release, the tension setting reverts to a zero setting.

The anti-lock brake system of the instant invention functions in the following manner when it is desired to pivot cuff rearward for braking. Bar 24*d* is adjusted so that spool 24*k* is in a desired position above cable 34 (FIG. 1). Backward pivoting of the cuff will cause spool 24*k* to contact cable 34 and create a rearward pull thereon. Rearward movement of cable 34 will also cause rearward movement of channels 30*a*. Such movement will allow brake shoes 30 to pivot (via arms 30*c*, plates 30*g*, and joints 30*f*) into contact with adjacent wheels 16 to initiate braking action. Since spring(s) 32 is biased against the rearward pull on the cable, the tendency will always be to return the shoes to a position out of contact with the wheels and thus preventing brake lock-up.

Brake shoe 28 adjacent the rearmost wheel functions in a similar manner in that rearward movement of cable 34 would function to cause brake rod 46 to move downward such that shoe 28 would come into braking contact with rear wheel 16. Spring 42 will tend to pull rod 46 upward thereby preventing lockup at the rear wheel.

As described above, braking action is initiated when the boot cuff is pivoted in a backward direction. To change to a forward direction, it is merely required that the cable 34 is positioned above the spool instead of below. Tension may be set and locked so that brake contact will prevent the wheels from turning thus allowing the skater to walk on the skates.

It is to be understood that the present invention is not limited to the embodiment described above, but encompasses any and all embodiments within the scope of the following claims.

I claim:

1. An anti-lock braking system for in-line skates comprising:

a boot having a front end a rear end;

a cuff articulated to said boot for forward or rearward pivoting;

a frame attached to said boot, said frame extending from said front end to said rear end;

a plurality of wheels including a rear-most wheel attached to said frame for rotation thereon, said plurality of wheels aligned in a single row from said front end to said rear end;

a plurality of arcuate-shaped brake shoes, each of said plurality of arcuate-shaped brake shoes being disposed adjacent each of said plurality of wheels;

a cable connected to said arcuate-shaped brake shoes;

means for biasing said arcuate-shaped brake shoes out of contact with said wheels, said biasing means including a spring attached to said frame at said front end and a wish bone assembly attached to said boot at said rear end, said wish bone assembly including a pair of rollers, said biasing means further including a plurality of channels attached securely to said cable, wherein said cable is connected to said arcuate-shaped brake shoes via said channels and engages said pair of rollers; and means for engaging said cable to move said arcuate-shaped brake shoes into braking contact with said wheels.

2. An anti-lock braking system as defined in claim 1, wherein said means for engaging said cable comprises a brake line adjuster assembly disposed on said boot at said rear end and positioned adjacent to and above said wish bone assembly.

3. An anti-lock braking system as defined in claim 2, wherein said brake line adjuster assembly includes a vertically adjustable bar, said bar having a lower end adapted to engage said cable.

4. An anti-lock braking system as defined in claim 3, wherein said vertically adjustable bar has a serrated side and said brake line adjuster assembly includes a rotatable gear element meshed with said serrated side.

5. An anti-lock braking system as defined in claim 4, wherein said brake line adjuster assembly includes a rotatable hub, said rotatable hub engaged to rotate said gear element.

6. An anti-lock braking system as defined in claim 5, wherein said rotatable hub has an outer surface, said outer surface having a rubber coating thereon.

7. An anti-lock braking system for in-line skates comprising:

a boot having a front end a rear end;

a cuff articulated to said boot for forward or rearward pivoting;

a frame attached to said boot, said frame extending from said front end to said rear end;

a plurality of wheels including a rear-most wheel attached to said frame for rotation thereon, said plurality of wheels aligned in a single row from said front end to said rear end;

a plurality of arcuate-shaped brake shoes each of said plurality of arcuate-shaped brake shoes being disposed adjacent each of said plurality of wheels;

a first cable, said first cable connected to said arcuate-shaped brake shoes;

first means connected to said first cable for biasing said arcuate-shaped brake shoes out of contact with said wheels, said first means including a wish bone assembly attached to said boot at said rear end, wherein said wish bone assembly includes an adjustable rod having a lower end and an upper end, a second cable attached to said upper end, and one of said plurality of arcuate-shaped brake shoes attached at said lower end; and second means for engaging said first cable to move said arcuate-shaped brake shoes into braking contact with said wheels.

8. An anti-lock braking system as defined in claim 7, wherein said one of said plurality of arcuate-shaped brake shoes is disposed adjacent said rear-most wheel.

9. An anti-lock braking system as defined in claim 8, wherein said first means includes a spring attached to said upper end of said adjustable rod, said spring adapted to bias said rod in an upward direction.

10. An anti-lock braking system as defined in claim 9, wherein said second means includes a small roller attached to said wish bone assembly and engaged with said second cable.

11. An anti-lock braking system as defined in claim 9, wherein said first means includes a spring attached to said frame at said front end.

12. An anti-lock braking system as defined in claim 11, wherein said first means includes a plurality of channels attached securely to said first cable, said first cable connected to said arcuate-shaped brake shoes via said channels.

13. An anti-lock braking system as defined in claim 12, wherein said second means for engaging said cable comprises a brake line adjuster assembly disposed on said boot at said rear end and positioned adjacent to and above said wish bone assembly.

14. An anti-lock braking system as defined in claim 13, wherein said brake line adjuster assembly includes a vertically adjustable bar, said bar having a lower end adapted to engage said first cable.

15. An anti-lock braking system as defined in claim 14, wherein said vertically adjustable bar has a serrated side and said brake line adjuster assembly includes a rotatable gear element meshed with said serrated side;

a rotatable hub having an outer surface, said rotatable hub engaged to rotate said gear element; and said outer surface having a rubber coating thereon.

* * * * *